US006079877A

United States Patent [19]

Chew

[11] Patent Number: 6,079,877

[45] Date of Patent: Jun. 27, 2000

[54] PLASTIC BAG WITH TRIANGULAR CUT TABS

[75] Inventor: Yook-Meng Chew, Port Lavaca, Tex.

[73] Assignee: Inteplast Group, Ltd., Livingston, N.J.

[21] Appl. No.: 09/098,022

[22] Filed: Jun. 15, 1998

[51] Int. Cl.[7] ..... B65D 33/14

[52] U.S. Cl. ..... 383/8; 383/9; 206/554

[58] Field of Search ..... 383/8, 9; 206/554

[56] References Cited

U.S. PATENT DOCUMENTS

| | | | |
|---|---|---|---|
| 5,465,846 | 11/1995 | Blyth et al. | 206/554 |
| 5,561,967 | 10/1996 | Nguyen | 383/9 |
| 5,562,580 | 10/1996 | Beasley et al. | 493/194 |
| 5,845,779 | 12/1998 | Wilfong, Jr. et al. | 383/9 |
| 5,865,313 | 2/1999 | Huang et al. | 383/9 |

*Primary Examiner*—Stephen P. Garbe

*Attorney, Agent, or Firm*—William H. Pavitt, Jr.; David A. Belasco; Mario A. Martella

[57] ABSTRACT

A plastic T-shirt bag pack in which the outer walls of adjacent bags have been corona-treated and each bag is provided with a central rack mounting tab with a pair of angled lines coming together in an apex adjacent the upper edge of the central tab, the lines being readily severable when the tab is placed on the central mounting element of a conventional rack. At their opposite ends the lines are curled inwardly toward each other to prevent their tearing from propagating down into the bag walls. This may be further prevented by providing a sinusoidal cut below the lower extremities of the angled lines. The area between the apex and upper edge of the tab is provided with a tear start so that when the bag is pulled from the rack, the area is severed to permit removal of the tab with the bag. Appropriately disposed pressure points with the corona treatment above, enable the bags of the pack to be self-opening.

2 Claims, 2 Drawing Sheets

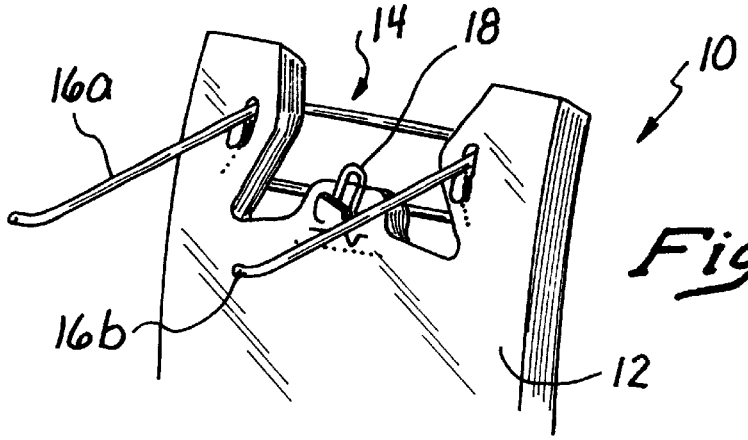
Fig. 1
Fig. 2
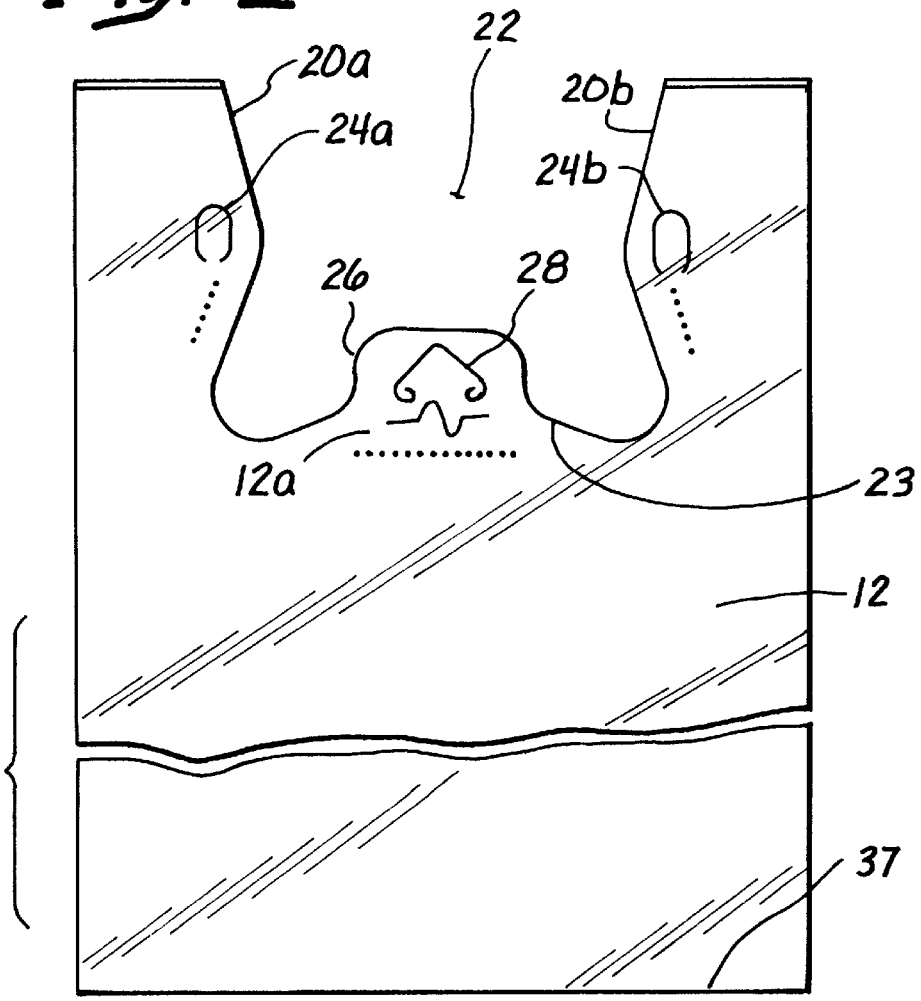

PLASTIC BAG WITH TRIANGULAR CUT TABS

FIELD OF THE INVENTION

This invention relates to the field of plastic shopping bags and, particularly, to those shopping bags such as what are called T-shirt bags and other bags which are provided in stacks to be mounted on, and supported by, a rack, one element of which is a central upwardly extending retainer.

DESCRIPTION OF THE PRIOR ART

Ever since plastic T-shirt bags have been developed and utilized, it has usually been the practice to mount them by means of tabs projecting upwardly from the lower area of the bag mouth. An early example of such a bag may be found in U.S. Pat. No. 4,165,832 which issued on Aug. 28, 1979 to Mobil Oil Corporation, as assignee of the inventors. FIG. 4 of this patent is illustrative of an early bag design for mounting on a centrally disposed rack retainer. Subsequently issued patents, namely U.S. Pat. No. 4,529,090 and No. RE 33,264 also show the use of a central tab to support at least the central areas of bags disposed on dispensing racks.

It will be observed, however, that in these prior art bag constructions, the central mounting tabs are orificed below their upper edges to enable the tab to be slipped over the central retainer element in a rack such as that shown in Reissue Patent 33,264. There is further provided, however, a second cut or at least perforated area below the mounting slot, the purpose of which second cut or perforation being to enable the central mounting tab to be detached from the upper edges of the bag walls at the time the bag has been filled and is being removed from the rack. This detachment is further made possible by the fact that the tabs of all of the bags in the bag stack are secured together in register by having been subjected to a hot pin passed through all of the tabs at the time rectangular bag blanks are being cut to shape, and slotted, perforated or cut by a die which is brought down on the bag stack to produce a stack of bags which can be mounted on the central retainer of a now conventional rack.

A principal problem with this type of bag stack is that the detachable tabs, being adhered together, remain on the retainer as a plug after their respective bags have been detached from them. Before the next stack of bags may be mounted on the rack, it is necessary to remove this plug and in some manner dispose of it. This not only impedes the work of the person at the checkout counter, but produces waste material which must be disposed of in some environmentally acceptable manner. While attempts to obviate this problem have been made in U.S. Pat. Nos. 5,269,605 and 5,346,310 by providing in the tab a single cut of a special configuration, when an effort is made to use such cut for mounting purposes and to allow for rupturing the slot upon removal of the bag, as taught in U.S. Pat. Nos. 5,269,605 and 5,346,310, it will be found that the breakout may actually occur at the time the rack retainer is pushed through the mounting slots of the bags in the bag pack. This results in the centers of the bags being improperly supported during the opening and filling of the bags.

SUMMARY OF THE INVENTION

The present invention effectively eliminates the necessity of dealing with detachable mounting tabs by providing a special orificed projection which extends upwardly for a short distance from the level of the bottom of the bag mouth. This projection may be provided with an opening of a triangular shape with the apex of the triangle extending upwardly and formed by two cuts spaced from each other at their lower ends and brought together at their upper ends to define a triangular flap between the cuts. This triangular opening enables the projection to be slipped over the rack retainer, but the latter, upon insertion into the triangular opening, is prevented from causing the opening from being extended downwardly into the bag walls by having the lower end of each cut forming the opening turned inwardly and upwardly and spaced from the opposite inwardly and upwardly extending end of the other cut forming the triangular opening. Any tendency, therefore, on the part of either cut to be lengthened upon the insertion of the retainer element into the triangular opening by a tear simply results in the tear being directed back upwardly toward flaps in the triangular opening. However, in order to insure that any tearing of the lower end of the triangular cut will not be propagated downward into the bag walls, provision is made for a transverse cut or perforated line directly below the triangular orifice. This cut or line will intercept any tear which may be initiated above it and dissipate it along the direction of the line or cut. The latter may be of any shape so long as its ends are not directed downwardly into the bag walls. The preferred shape, however, may be sinusoidal.

In addition, to facilitate a breach of the upper portion of the projection, when it is desired to remove the bag from the rack, there is provided to extend from the apex of the triangular opening a short initiating tear line. When the mounting projection is pulled against the retainer, the upper portion of the projection above the opening apex will tear in the direction of initiating tear line.

It is also a feature of the present invention to eliminate the use of a hot pin passed through adjacent the mounting when the bag stack is die cut. This is accomplished by corona-treating the outside of the bag walls, in the manner taught by my co-pending application Ser. No. 09/050,708, filed Mar. 30, 1998, in conjunction with a pair of pressure points on each corner of the projection and offset from the apex of the triangular opening. These pressure points, in conjunction with effective corona-treatment of the outside walls of the bags will produce the desired detachable adherence of the projections of adjacent bags, so that each bag will easily self-open as its preceding bag is pulled out off the rack on which the pack of such bags is mounted.

DESCRIPTION OF THE DRAWINGS

In the accompanying drawings,

FIG. 1 is a perspective view of the upper portion of a stack of T-shirt bags made in accordance with the present invention and mounted on a conventional rack.

FIG. 2 is an enlarged plan view of a bag of a type shown in FIG. 1.

DESCRIPTION OF THE PREFERRED EMBODIMENT

Figure 3:
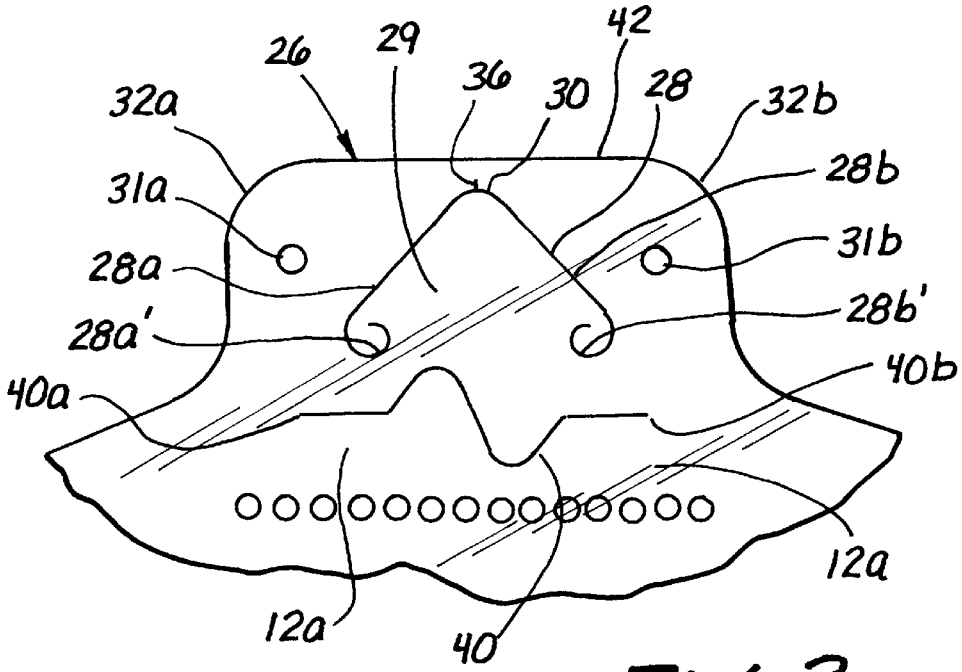
FIG. 3 is an enlarged center upwardly projecting portion of the bag shown in FIG. 2.

Referring to FIG. 1 of the drawings, there is shown a stack 10 of bags 12 mounted on a conventional rack 14 which has a pair of forwardly projecting arms 16*a,* 16*b,* and a central upwardly extending retainer element 18. As better shown in FIG. 2, each bag 12 is of the T-shirt type having a pair of handles 20*a,* 20*b* spaced from each other to define the side of a bag mouth 22.

Figure 4:
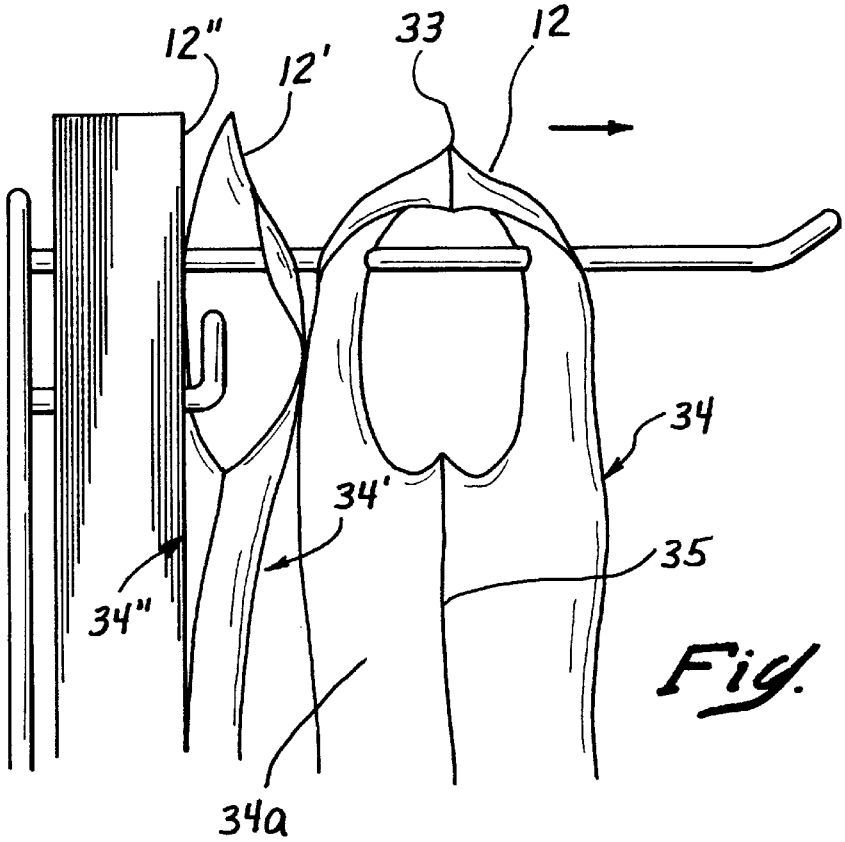
FIG. 4 is a side view of a stack of bags mounted on a rack shown in FIG. 1, but with the first bag being removed from the rack arms and drawing the front wall of the next ensuing bag outwardly to open the same

As is well understood by those skilled in the art, and as may be seen particularly from FIGS. 1 and 4, the T-shirt bag is formed of a front wall 34 and a back wall 34*a,* joined at their top, side and bottom edges, 33, 35, 37, respectively, with both walls 34, 34*a* cut out to provide a bag mouth 22 defined on its sides by handles 20*a,* 20*b* spaced from each other and by an intermediate central extent 23 between the handles 20*a,* 20*b* (FIG. 2). Each bag handle 20*a,* 20*b* is provided with a cut 24*a,* 24*b,* which enables the rack rods 16*a,* 16*b* to be passed through the bag handles for mounting as shown in FIG. 1. However, instead of being provided with a detachable central mounting tab of the prior art, the central extent 23 of the walls 34*a,* 34*b* of each bag 12 is formed with an upwardly extending projection 26 having a central triangulated opening 28 defining a flap 29.

As more clearly shown in FIG. 3, the triangulated opening 28 may be formed by a pair of cuts 28*a,* 28*b,* which are angled at their upper ends towards each other to join at an apex 30. The lower ends 28*a'* and 28*b'* of the cuts 28*a,* 28*b,* respectively, are preferably curled inwardly and upwardly into the flap 29. Extending transversely below the triangulated opening 28 and spaced from the lower ends 28*a'*, 28*b'*, of the cuts 28*a,* 28*b,* respectively, may be provided a cut or perforated line 40, shown in the drawing to be sinusoidal, although, as hereinabove stated, it may be of any configuration, but the ends 40*a,* 40*b* of which are not directed downwardly into bag walls 12*a.*

In addition, there are also provided a pair of pressure points 31*a,* 31*b* offset from the triangulated opening 28 toward the corners 32*a* and 32*b* of the projection 26.

It should also be understood that, in accordance with the teachings of my co-pending application previously mentioned, the outer walls 34, 34', 34", etc. of sequential bags 12, 12', 12", etc. respectively, have been corona-treated to result, in conjunction with pressure points, 31*a,* 31*b,* in the adherence in register of the projections 26 of bags 12, 12', 12", etc. to adjacent such projections (not shown). Thereby, it is un-necessary to secure the adjacent projections 26 together in register by means of a hot pin as is done in the case of most of bag packs having detachable mounting tabs.

It is also a feature of the present invention to provide a tear start 36 extending a short distance from the apex 30 of the triangulated opening 28 toward the upper edge 42 of the projection 26.

In use, it may be seen that bags 12 fabricated in accordance with the present invention may readily be mounted upon the retainer 18 of a rack 16 by simply pushing the retainer 18 against the triangulated flap 29 to loop the opening 28 over the retainer 18 while simultaneously the handle openings 24*a,* 24*b,* are moved over the rods 16*a,* 16*b.* Should the insertion of the retainer 18 into the opening 28 result in any tendency on the part of the opening 28 to be expanded and tear at the ends 28*a'* and 28*b'* of the cuts 28*a,* 28*b,* those tears will ordinarily be propagated upwardly and into the triangulated flap defined by the cuts 28*a,* 28*b.* If, for any reason, the tears should begin to propagate downwardly toward the bag walls 12*a,* they will be intercepted by the cuts or perforated line 40 and dissipated laterally.

It is also a feature of the present invention that when a bag 12 being removed from the rack 16, as the apex 30 of the triangulated opening 28 is pulled against the retainer 18 to the point of opening up the tear start 36, the latter will propagate further tearing toward the upper edge 42 of the projection 26 to place the opening 28 in communication with the bag mouth 22. Thereby, the bag projection (mounting tab) 26 is no longer restrained by the retainer 18 and is removed from the retainer element 18 together with the remainder of the bag.

I claim:

1. A plastic T-shirt bag for dispensing as a part of a stack of such bags from a rack having a pair of forwardly extending arms spaced from each other and an upwardly extending retainer element disposed equidistantly between the rack arms, said bag being formed of a front wall and a back wall, the outsides of said walls having been corona treated, said walls being secured to each other along at least a portion of their side edges and their top and bottom edges, said walls being cut out inwardly from the center of their top edges to form a bag mouth defined along its side edge by a pair of handles spaced apart from each other and, its lower innermost area, by an inner edge of the cut-out extending between the handles, each of said handles having an orifice to receive one of the forwardly extending arms of said rack, and mounting tabs projecting upwardly into the lowermost inner area of the bag mouth from the inner edges of the cut-out of the walls, and unitary with the respective walls, for mounting on the retainer element of the rack, each of said tabs having within its area a centrally disposed pair of upwardly extending angular cuts, said cuts being brought together at their upper ends to define an upwardly directed angular flap which, when pulled down, forms a triangular opening, the apex of which opening is directed toward, but spaced from the bag mouth, the lowermost end of each cut terminating in an inwardly and upwardly turned curve spaced from the inwardly and upwardly oppositely turned curve of the other cut, a severable area adjacent the triangular opening, and extending toward the top edge, of each tab, and a transverse slot in each tab disposed below the inwardly curved ends of the tab cuts and extending laterally beyond said cut ends whereby when the bag handles are mounted on the rack arms and the tabs are mounted on the retainer element of the rack by placing their triangular openings over said retainer element, the bag may be removed from said element by pulling the tabs against the element to cause the element to tear at severable areas of the tabs, thereby leaving no portion of the tabs on the retainer element.

2. A plastic T-shirt bag as described in claim 1 wherein the slot is sinusoidal in shape for at least a portion of its extent.

* * * * *